US006711833B1

(12) United States Patent
Ransan

(10) Patent No.: US 6,711,833 B1
(45) Date of Patent: Mar. 30, 2004

(54) TAP SHOE AND FASTENING ASSEMBLY AND METHOD FOR ATTACHING TAP TO DANCE SHOE

(76) Inventor: Lisias Ransan, 10569 Mendocino La., Boca Raton, FL (US) 33428

( * ) Notice: Subject to any disclaimer, the term of this patent is extended or adjusted under 35 U.S.C. 154(b) by 0 days.

(21) Appl. No.: 10/339,510

(22) Filed: Jan. 9, 2003

(51) Int. Cl.[7] ..... A43B 5/12
(52) U.S. Cl. ..... 36/8.3
(58) Field of Search ..... 36/8.3, 131, 134, 36/67 D; 411/399, 338, 339

(56) References Cited

U.S. PATENT DOCUMENTS 63,497 A * 4/1867 Frank ..... 24/37
180,376 A * 7/1876 Rogers ..... 36/13
375,177 A * 12/1887 McKinnon ..... 411/338
1,763,543 A * 6/1930 Sothen ..... 36/8.3
1,950,041 A * 3/1934 Torchia et al. ..... 411/399
1,967,334 A * 7/1934 Sothen ..... 36/8.3
2,173,599 A * 9/1939 Sothen ..... 36/8.3
2,192,150 A * 2/1940 Pierce et al. ..... 36/134
2,708,321 A * 5/1955 Cathers et al. ..... 36/8.3
2,746,175 A * 5/1956 Root ..... 36/8.3
5,459,946 A * 10/1995 Rayow ..... 36/8.3
6,598,317 B1 * 7/2003 Le Vine et al. ..... 36/8.3

* cited by examiner

*Primary Examiner*—Ted Kavanaugh
(74) *Attorney, Agent, or Firm*—Frank J. Benasutti

(57) ABSTRACT

A tap shoe assembly is disclosed wherein screws pass through the tap and an intermediate resilient composition material and into conically-shaped nuts embedded in the sole of the shoe.

6 Claims, 1 Drawing Sheet

TAP SHOE AND FASTENING ASSEMBLY AND METHOD FOR ATTACHING TAP TO DANCE SHOE

BACKGROUND OF THE INVENTION

1. Technical Field

This invention relates to shoes specifically made for tap dancing, and in particular, to an assembly for fastening the tap and sole of the shoe together.

2. Background Art

In the prior art, it is known to secure the tap of a tap shoe to the sole of the shoe with flat head machine screws passing through the bottom of the tap and into nuts retained in the sole of the shoe. See, for example, U.S. Pat. No. 5,459,946.

In the use of tap shoes, it is desirable to adjust the machine screws so that they can be adjusted for tightness, but still will not come loose during use.

SUMMARY OF THE INVENTION

My invention comprises a tap shoe fastening assembly wherein machine screws pass through the tap and a resilient composition sole material and into a conically-shaped nut embedded in the sole of the shoe.

DESCRIPTION OF THE PREFERRED EMBODIMENT

Figure 1:
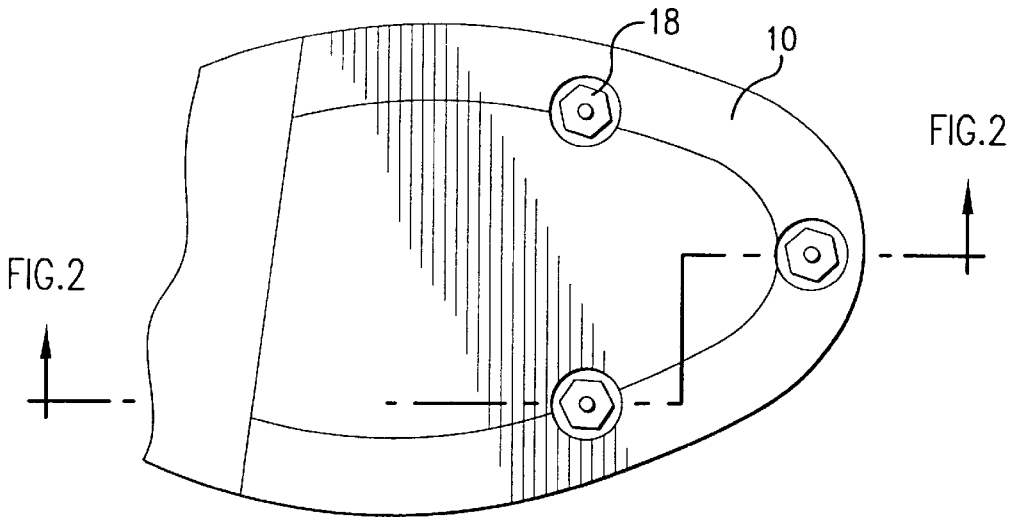
FIG. 1 is a top plan view of a portion of the inside of the sole of a tap shoe in accordance with my invention.
Figure 2:
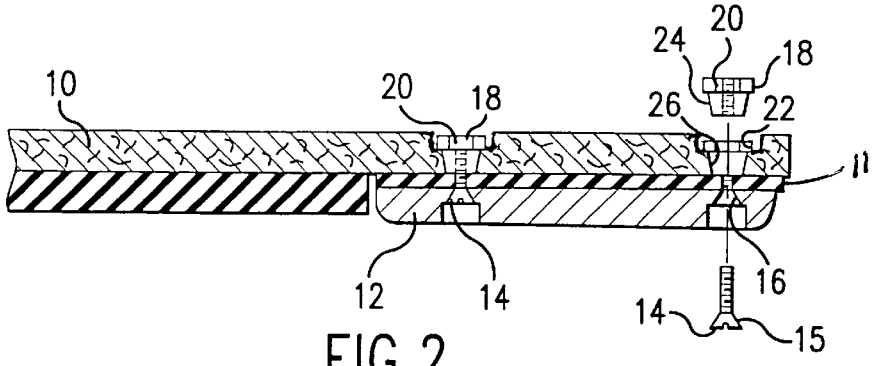
FIG. 2 is a partial cross-section, partially broken away and partially exploded of a fastening assembly and shoe sole taken along the lines and arrows 2—2 of FIG. 1.
Figure 3:
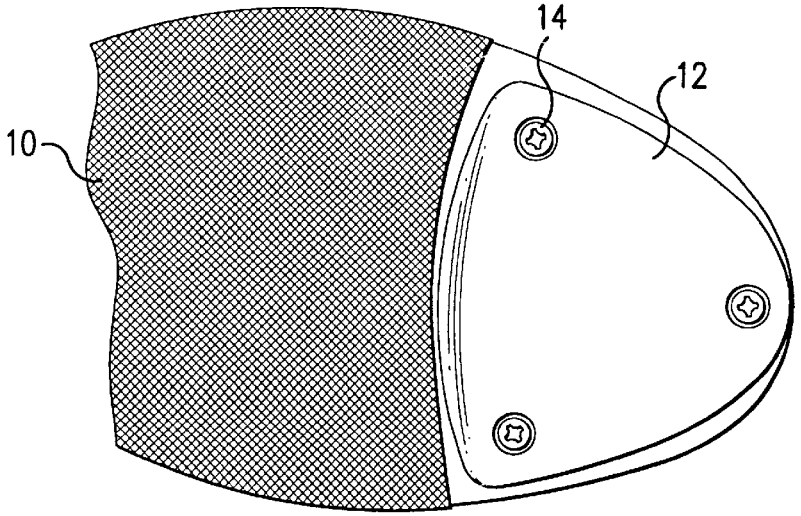
FIG. 3 is a bottom plan view of the shoe shown in the previous Figures.

Referring to the Figures, a tap shoe (not shown in detail, but well known in the art) has a sole means, comprising a sole 10 made of a suitable material. Between the sole and the tap 12, there is a composite resilient material 11; most preferably made of polycarbonate. The tap 12 to be fastened on the end of the shoe is made of a suitable metal.

To retain the tap to the sole material, screw means, such as flat head machine screws 14 are used. The machine screws pass through a hole in the tap 12 and the material 11 and the sole 10. Each of the machine screws 14 has a conical shape 15 below its flat head. Each is placed into a countersunk hole, such as 16.

Nut means, such as the nut 18 has a polygonal-shaped head 20 and is placed in a suitably counterbored hole 22 in the inside of the shoe material 10. The nut 18 does not rotate when assembled with the screw 14.

The shank portion 24 of the nut 18 is conical, and fits in a countersunk conical hole 26 in the sole 10.

In the arrangement shown, the threaded screw 14 can be tightened into the threaded nut 18 to draw the tap 12 tight against the sole 10. On the other hand, if it is desirable to adjust the tightness with which this tap is maintained against the sole, the screw 14 can be backed off slightly. Since the material 11 is resilient and since both the screw head and nut shank are conical in shape and fit into conical countersunk holes, this adjustment can be made without the screw coming loose.

What is claimed is:

1. A tap shoe assembly comprising:

a sole having conically shaped holes therethrough;

a tap;

a resilient material positioned between the sole and the tap;

a plurality of screws positioned through holes in the resilient material and tap; nuts provided on the side of the sole remote from the resilient material for receiving the screws;

said nuts having conically-shaped surfaces mating with the conically shaped surfaces of holes in the sole.

2. The assembly of claim 1 wherein the screws have conical surfaces;

and the tap has holes with conical surfaces;

and the conical surfaces of the screws and tap are in engagement.

3. The assembly of claim 2 wherein the resilient material is polycarbonate.

4. The assembly of claim 1 wherein the resilient material is polycarbonate.

5. A method of fastening a tap to a shoe, comprising the steps of:

providing a sole in the shoe; which sole has holes therethrough having conical surfaces;

proving a tap having holes therethrough having conical surfaces;

positioning a resilient material between the tap and the sole; and fastening the tap to the sole with a fastening means having conical surfaces mating with the conical surfaces of the holes in the sole and tap.

6. The method of claim 5 wherein the resilient material provided is polycarbonate.

* * * * *